US005736311A

United States Patent [19]

Urabe

[11] Patent Number: 5,736,311

[45] Date of Patent: Apr. 7, 1998

[54] SILVER HALIDE PHOTOGRAPHIC EMULSION CONTAINING TABULAR GRAINS WITH DISLOCATIONS AND METHOD OF PREPARING THE SAME

[75] Inventor: Shigeharu Urabe, Kanagawa, Japan

[73] Assignee: Fuji Photo Film Co., Ltd., Kanagawa, Japan

[21] Appl. No.: 600,871

[22] Filed: Feb. 13, 1996

[30] Foreign Application Priority Data

Feb. 15, 1995 [JP] Japan ..... 7-049267

[51] Int. Cl.[6] ..... G03C 1/035; G03C 1/015; G03C 1/07

[52] U.S. Cl. ..... 430/569; 430/567

[58] Field of Search ..... 430/567, 569

[56] References Cited

U.S. PATENT DOCUMENTS 4,806,461 2/1989 Ikeda et al. ..... 430/567
4,983,508 1/1991 Ishiguro et al. ..... 430/569
5,498,516 3/1996 Kikuchi et al. ..... 430/567
5,550,014 8/1996 Maruyama et al. ..... 430/567

FOREIGN PATENT DOCUMENTS 0460656 12/1991 European Pat. Off. ..... G03C 1/035

*Primary Examiner*—Mark F. Huff
*Attorney, Agent, or Firm*—Sughrue, Mion,Zinn, Macpeak & Seas, PLLC

[57] ABSTRACT

A silver halide photographic emulsion is disclosed, which comprises core/shell type tabular silver halide grains having a diameter/thickness ratio of at least 2 and (111) faces as parallel main planes; wherein at least 30%, on a projected area basis, of the total silver halide grains are tabular grains which contain in their individual shells at least 15 dislocation lines reaching to the grain edges from the interface of the core and the shell and have the ratio of the shell part containing dislocation lines to the core, on a projected area basis, in the range shown as the shaded part in FIG. 1, thereby ensuring high sensitivity and high sharpness.

2 Claims, 2 Drawing Sheets

Emulsion 1

Emulsion 2

Emulsion 5

SILVER HALIDE PHOTOGRAPHIC EMULSION CONTAINING TABULAR GRAINS WITH DISLOCATIONS AND METHOD OF PREPARING THE SAME

FIELD OF THE INVENTION

The present invention relates to a silver halide photographic material and, more particularly, to a tabular-grain silver halide emulsion having high sensitivity and excellent graininess and improved resistance to damage by pressure, and to a photosensitive material using such an emulsion.

BACKGROUND OF THE INVENTION

Photographic characteristics of tabular silver halide emulsion grains (which are abbreviated as "tabular grains", hereinafter) are as follows:

(1) Color sensitization sensitivity of tabular grains is relatively high for their intrinsic sensitivity, because the grains have a great surface area/volume ratio (which is referred to as specific surface area, hereinafter) to enable the adsorption of a large quantity of sensitizing dye on their surfaces.

(2) When an emulsion comprising tabular grains is coated on a support and dried, the grains are aligned so as to be parallel to the support surface. Accordingly, the thickness of the coated layer can be rendered thin; as a result, the photographic material using such an emulsion can have high sharpness.

(3) In an X-ray photographic system, silver halide cross-over light can be considerably reduced when sensitizing dyes are added to tabular grains, thereby preventing the deterioration of image quality.

(4) Tabular grains are poor light scattering, and so an image having high resolution can be obtained.

(5) Tabular grains have low sensitivity to blue light, and so a yellow filter can be removed from the emulsion when they are used in a green-sensitive or red-sensitive layer.

As tabular grains have many advantages as mentioned above, they have so far been used in commercially available high-speed photosensitive materials. JP-B-06-44132 and JP-B-05-16015 (the term "JP-B" as used herein means an "examined Japanese patent publication") disclose the tabular emulsion grains having an aspect ratio of at least 8. The term "aspect ratio" as used herein is defined as the diameter/thickness ratio of a tabular grain. The term diameter used herein refers to the diameter of a circle having the same area as the projected area of a tabular grain which is determined by the observation under a microscope or an electron microscope. The term "thickness", on the other hand, refers to the distance between two parallel faces constituting a tabular grain.

In addition, JP-B-04-36374 describes the color photosensitive material whose sharpness, sensitivity and graininess are improved by using tabular grains having a thickness of less than 0.3 μm and a diameter of at least 6 μm in at least one layer of a green-sensitive emulsion layer and a red-sensitive emulsion layer.

Although silver halide photosensitive materials have undergone developments of the sensitivity increase and the format-size reduction in recent years, it is strongly desired to introduce further improvements in sensitivity and image quality on color photosensitive materials. For the accomplishment of such a desire, it is required to develop silver halide emulsion grains having higher sensitivity and more excellent graininess. However, conventional tabular silver halide emulsion grains are insufficient for the aforementioned requirements, and so it is desired to introduce therein further improvements of photographic properties. Recently, on the other hand, the speeding-up and simplification of photographic processing and the reduction in the quantity of waste processing solutions for the purpose of environmental preservation have been sought after. In order to meed such requirements, it is necessary to increase the silver/gelatin or silver/binder ratio. However, an increase in silver/gelatin ratio causes deterioration in mar resistance of an emulsion, and so it becomes important to improve the mar resistance of tabular silver halide emulsion grains.

The present invention relates to tabular silver halide grains containing dislocations. As for the dislocations of silver halide crystals, the following literatures can be referred to:

(1) C. R. Berry, *J. Appl. Phys.*, 27, 636 (1956).

(2) C. R. Berry and D. C. Skillman, *J. Appl. Phys.*, 35, 2165 (1964).

(3) J. F. Hamilton, *Photogt. Sci. Eng.*, 11, 57 (1967).

(4) T. Shiozawa, *J. Soc. Photogr. Sci. Tech. Japan*, 34, 16 (1971).

(5) T. Shiozawa, *J. Soc. Photogr. Sci. Tech. Japan*, 35, 213 (1972).

Therein, it is described that the existence of dislocations in crystals can be observed by X-ray diffractiometry or low-temperature transmission electron microscopy, various dislocations can be produced in crystals by application of strains, and so on.

JP-B-06-70708 and JP-A-01-20149 (the term "JP-A" as used herein means an "unexamined published Japanese patent application") disclose the tabular silver halide emulsion grains into which dislocations are intentionally introduced. Therein, it is demonstrated that the dislocation-introduced tabular grains are excellent in photographic characteristics, including sensitivity and reciprocity law, compared with tabular grains containing no dislocation and, what is more, the photosensitive materials using those tabular grains can have excellent sharpness and graininess.

Further, JP-A-03-175440 discloses the tabular silver halide grains having an aspect ratio of at least 2 and containing dislocations concentrated in the vicinity of vertices of each grain; while JP-A-4-178643 discloses the tabular silver halide grains having an aspect ratio of at least 2 and contain dislocations localized around the center of each grain. Furthermore, JP-A-04-251241 discloses the tabular silver halide grains having an aspect ratio of at least 2 and containing dislocations at their main planes. In those inventions, the tabular grains containing dislocations are obtained by carrying out first the epitaxial deposition of AgCl on host grains, then the physical ripening and/or halogen conversion, followed by the shell formation.

SUMMARY OF THE INVENTION

It is therefore a first object of the present invention to provide high-speed tabular emulsion grains containing dislocation lines.

A second object of the present invention is to provide tabular silver halide emulsion grains which contain dislocation lines and can produce an image of high sharpness.

The above-described objects are attained by the following:

1. A silver halide photographic emulsion comprising tabular silver halide grains having a diameter/thickness ratio of at least 2 and (111) faces as parallel main planes, each of said grains being constituted of a core and a shell; wherein at least 30%, on a projected area basis, of the total silver halide grains are tabular grains which contain in their individual shells at least 15 dislocation lines reaching to the grain edges from the interface of the core and the shell and have the projected area ratio between the shell part in which the dislocation lines are present and the core (which is abbreviated as "the shell/core ratio", hereinafter) in the range shown as the shaded part in FIG. 1.

2. Preferably, a silver halide photographic emulsion as described above, wherein the tabular silver halide grains having a grain thickness of less than 0.5 μm, a grain diameter of at least 0.3 μm and an aspect ratio of at least 2 occupy at least 50%, on a projected area basis, of the total silver halide grains.

3. A method of preparing a silver halide photographic emulsion according to the above-described embodiment (1) or (2), wherein the shell containing dislocations is grown in the presence of a crystal habit controlling agent.

Figure 2A:
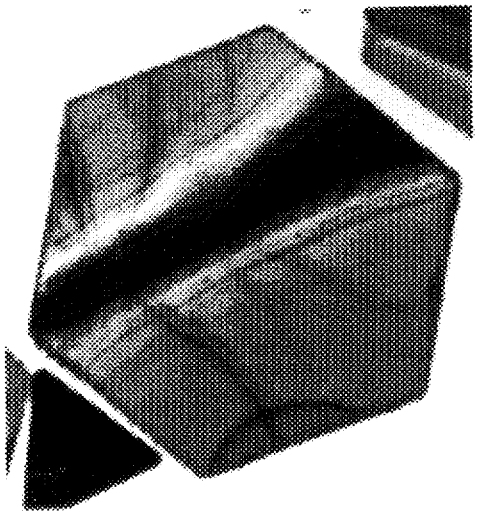
Figure 2B:
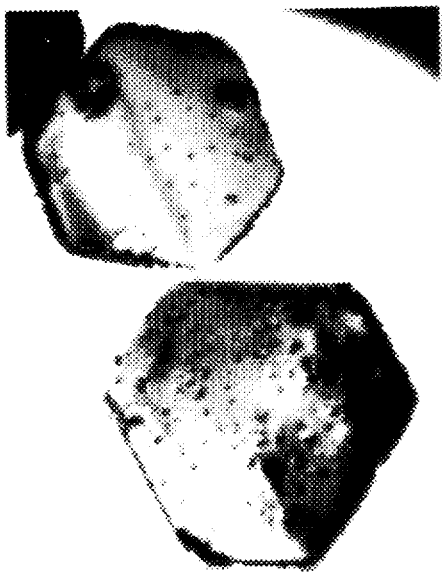
Figure 2C:
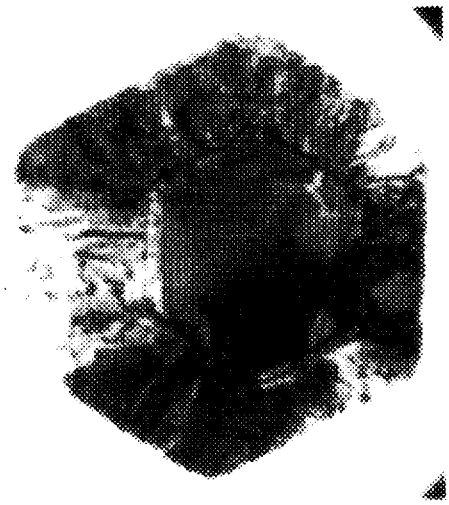

The electron micrographs in FIG. 2 show the crystal structures of Emulsions 1, 2 and 5 prepared in Example 1, respectively. The magnification of the electron microscope used was 30,000.

DETAILED DESCRIPTION OF THE INVENTION

The expression "tabular silver halide grains" in the present invention (abbreviated as "tabular grains", hereinafter) is intended to include the grains having two parallel main planes opposite each other, wherein the distance between the two main planes (i.e., the grain thickness) is at least twice as great as the diameter of the circle equivalent to the main plane (or the diameter of the circle having the same projected area as the main plane, which is called simply "diameter", hereinafter). For the present emulsion comprising tabular grains, it is desirable that an average diameter/thickness ratio of the grains be preferably from 3 to 30, more preferably from 4 to 20, and particularly preferably from 5 to 15. The average diameter/thickness ratio of the grains can be determined by averaging the diameter/thickness ratios of the total tabular grains. More simply, it can also be determined as the ratio of the average diameter of the total tabular grains to the average thickness of the total tabular grains.

The diameter (of the circle equivalent to the main plane) of the present tabular grains is preferably from 0.3 to 10 μm, more preferably from 0.5 to 5.0 μm, and most preferably from 0.5 to 2.0 μm. The grain thickness is preferably not more than 0.5 μm, more preferably not more than 0.4 μm, and most preferably from 0.06 to 0.3 μm. The diameter and thickness of the grains can be determined with electron micrographs, as described in U.S. Pat. No. 4,434,226. More specifically, the grain thickness can be easily determined by evaporating a metal obliquely onto a reference latex as well as the grains, measuring their shadow lengths on the electron micrograph, and then calculating the grain thickness by reference to the shadow length of the latex.

The present tabular grains have dislocations. The dislocations in tabular grains, as described, e.g., in J. F. Hamilton, *Photogt. Sci. Eng.*, 11, 57 (1967) and T. Shiozawa, *J. Soc. Photogt. Sci. Tech. Japan*, 35, 213 (1972), can be observed by the direct method using a low-temperature transmission electron microscope. More specifically, silver halide grains are taken out of an emulsion under safelight with care so that a mechanical strain (e.g., pressure) strong enough to produce dislocations in the grains will not be put thereon, set on a mesh for the observation by an electron microscope, and then observed by the transmission method wherein the sample is cooled in order to prevent the damage by electron beams (e.g., print-out). Since it is more difficult for electron beams to penetrate into grains the greater the grain thickness is, clearer observation can be achieved with an electron microscope with a higher voltage (e.g., 200 kV or more for the grains having a thickness of 0.25 μm). From the photograph obtained by the method as mentioned above, we can know the site and the number of dislocations in each grain observed at the direction perpendicular to the main planes.

Figure 1:
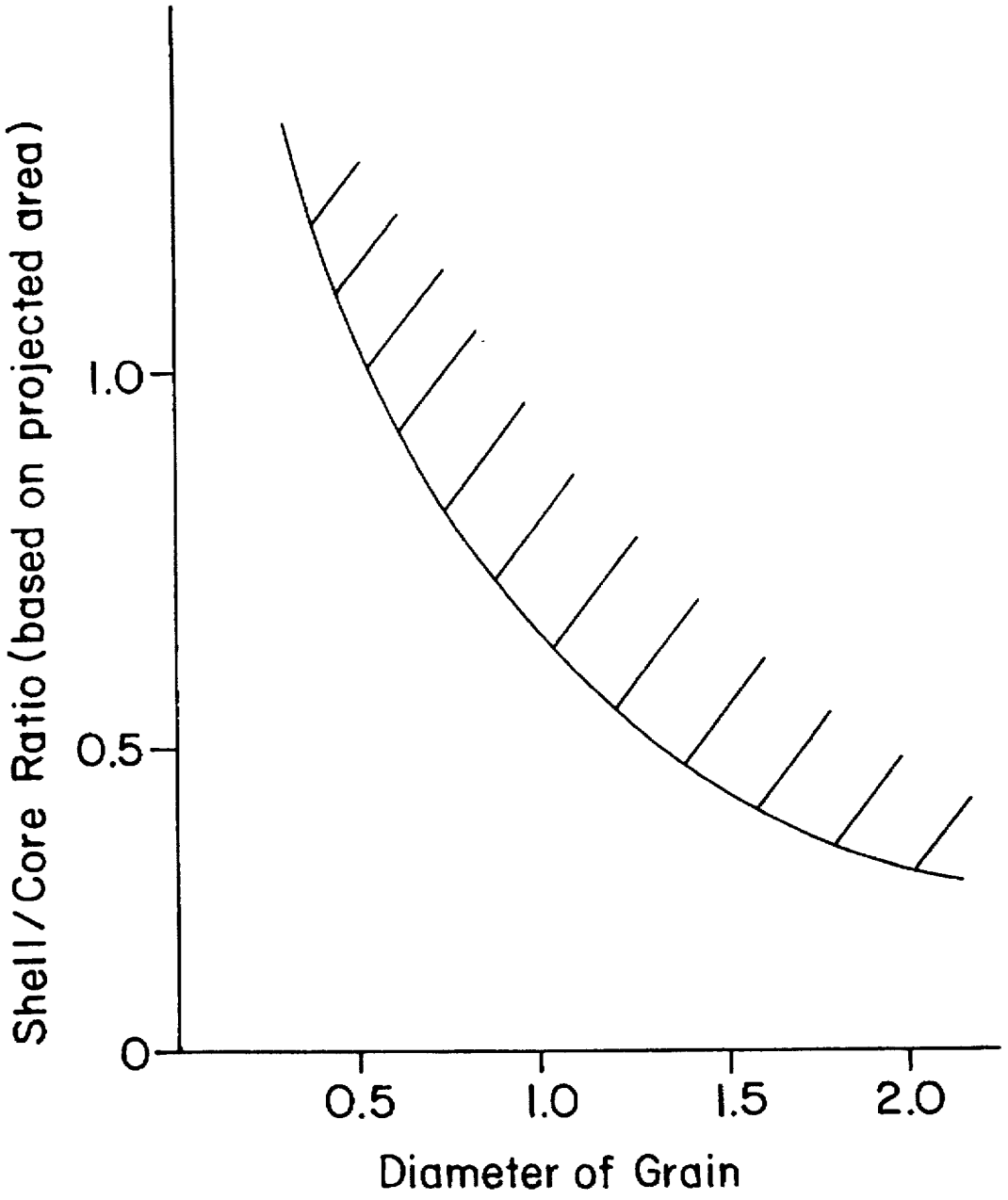
In FIG. 1, the numbers on the abscissa indicate the diameter (μm) of a circle corresponding to silver halide grains (the term "diameter" is defined hereinafter), and those on the ordinate indicate the shell/core ratio (on a projected area basis). The shaded range in FIG. 1 is the range of the present invention.

The site of dislocations in the present tabular grains is the shell part. The dislocations are produced at the interface of the core and the shell, and lengthened with the growth of the shell. Therein, the proceeding direction of each dislocation is occasionally at almost right angle to the grain side; while sometimes it is off the right angle, and the dislocation line curves. In the present tabular grains, the ratio between the projected area of the shell part containing dislocations and that of the core is in the range as shown in FIG. 1. It is seen from FIG. 1 that the range of the ratio depends on the diameter of the circle equivalent to the main plane. For instance, if the diameter of the circle equivalent to the main plane is 1.0 μm. The ratio between the shell part containing dislocations and the core is preferably from 0.6 to 9, more preferably from 0.8 to 5, on a projected area basis.

The tabular silver halide grains into which dislocations are intentionally introduced are disclosed in JP-B-06-70708 and JP-A-01-20149. In these references, it is demonstrated that the dislocation-introduced tabular grains are excellent in photographic characteristics, including sensitivity and reciprocity law, as compared with tabular grains containing no dislocation and, what is more, the photosensitive materials using those tabular grains can have excellent sharpness and graininess. As for the site of dislocations in the tabular grains, the former reference discloses on column 5 that the dislocations are present in the region extending to the side from the position corresponding to x % of the distance from the center to the side in the length direction of each tabular grain. Further, it discloses that the value of x is preferably in the range, $50 \leqq x < 95$. This range is corresponding to the shell/core ratio of 3 to 0.11 according to the present invention. However, that reference discloses only the cases of x=80 and x=90 in Examples thereof. That is, those cases are not included in the tabular grains defined by the present invention wherein the shell area in which dislocations are present has a large ratio.

The term "tabular silver halide grain" used in the present invention is a general name of the silver halide grain having one twinning plane or at least two parallel twinning planes. The twinning plane is defined as the (111) face on the both sides of which all ions on the lattice points bear a mirror-image relationship. Such a tabular grain has the shape of a triangle, a hexagon, a roundish triangle or a roundish hexagon when it is overlooked, so the shape of mutually parallel outer surfaces thereof is a triangle, a hexagon, a triangle whose angles are rounded off, or a hexagon whose angles are rounded off, respectively.

As the number of dislocation lines in the present tabular grains, it is desirable that the tabular grains containing at least 15 dislocation lines be present in a proportion of at least 30%, preferably at least 50%, more preferably at least 80%, on a projected area basis, to the total silver halide grains. In particular, it is most preferable that the grains containing at least 20 dislocation lines be present in a proportion of at least 80%, on a projected area basis, to the total silver halide grains.

As the halide composition of the tabular grain which can be used in the present invention, silver iodobromide, silver chloroiodobromide, silver iodochloride, silver iodobromochloride or silver chlorobromide is preferred. In particular, it is desirable for the tabular grains of the present invention to be silver iodobromide grains having an iodide content of preferably 0.1 to 20 mole %, more preferably 1 to 10 mole %.

The structure of halide compositions in the tabular grains which can be used in the present invention can be confirmed by the combined use of X-ray diffraction, EPMA (or XMA as another name) (which is a method of detecting a halide composition by scanning silver halide grains with electron beams), ESCA (in which photoelectrons emitted from grain surfaces upon irradiation with X-rays undergo spectroscopic analysis) and so on. The expression "grain surface" as used in the present invention signifies the region from the surface to a depth of about 50 Å, and the halide composition in such a region can be generally determined by ESCA. The expression "interior of a grain" signifies the region other than the surface region defined above.

The preparation method of tabular grains and the arts used therein are disclosed, e.g., in U.S. Pat. Nos. 4, 434,226, 4,439,520, 4,414,310, 4,433,048, 4,414,306 and 4,459,353. Further, as disclosed in JP-A-06-21433, it is possible to form tabular grains by first carrying out nucleation to prepare a seed-crystal emulsion, and then making the seed crystals grow by addition of silver and halide solutions under the pH, the pAg and other conditions properly adjusted for the crystal growth. In another suitable method, tabular grains are formed by adding fine grains of silver halide instead of an aqueous solution of silver salt and an aqueous solution of halides to a reaction vessel in which an aqueous solution of protective colloid is kept. The technique relating to this method are disclosed in U.S. Pat. No. 4,879,208, JP-A-01-183644, JP-A-02-4435, JP-A-02-43535 and JP-A-02-68538. As the method of supplying iodine ions during the formation of tabular grains, the addition of a fine-grain silver iodide emulsion (grain diameter: generally 0.1 μm or less, preferably 0.06 μm or less) may be adopted. Therein, the supply of fine-grain silver iodide is preferably carried out using the preparation method disclosed in U.S. Pat. No. 4,879,208.

It is desirable for the present invention to use monodispersed tabular grains. As to this subject, the monodispersed hexagonal tabular grains are disclosed in JP-A-63-11928 and JP-B-05-61205, and the monodispersed circular tabular grains are disclosed in JP-A-01-131541. Further, JP-A-02-838 discloses the emulsion in which the tabular grains having two twinning plates parallel to the main plane occupy at least 95%, on a projected area basis, of the total grains and such the tabular grains have a monodispersed size distribution. Furthermore, EP-514742 A discloses the tabular grain emulsion which is prepared in the presence of a polyalkylene oxide block copolymer and has a variation coefficient of not more than 10% with respect to the grain size.

The dislocations in the present tabular grains can be controlled by forming a particular iodide-rich phase (or a phase having a high iodide content) in the interior of each grain. More specifically, the dislocations can be produced through a process comprising the steps of preparing base grains (called "the core", hereinafter), forming a iodide-rich phase on the core in accordance with the method (1) or (2) described below, and then covering the resulting core with a phase having an iodide content lower than the iodide content in the iodide-rich phase to form a shell. The iodide content in the core of each tabular grain is lower than that in the iodide-rich phase, and the suitable iodide content therein is preferably from 0 to 12 mole %, more preferably from 0 to 10 mole %. The iodide-rich phase in the interior of each tabular grain is preferably constituted of silver iodide, silver iodobromide or silver chloroiodobromide, and more preferably silver iodide or silver iodobromide. Such the internal iodide-rich phase is not deposits uniformly covering the core surface, but it is important that the phase be deposits locally present on the core surface. As the localization (called "epitaxy", hereinafter) of iodide-rich phase, it is preferable for the deposition to occur on edges and corners of the core having a tabular shape, although localized deposition may occur on the main planes of the tabular core.

As the method (1) for forming an iodide-rich phase, the so-called conversion methods described in E. Klein, E. Moisar and G. Murch, *Photo. Korr.*, 102(4), 59–63 (1966) can be adopted. For instance, a halogen ion is added at some point of time on the way to the grain formation. Therein, it is necessary for the halogen ion added that the silver salt thereof be lower in solubility than the salt constituted of silver ion and a halogen ion which forms each of the grains at that point of time (or the vicinity of grain surface). In the present invention, it is desirable that the halogen ion lower in solubility of the silver salt thereof be added in an amount greater than a certain specific amount (relating to the halide composition) which varies against the surface area that each grain has at the time of halogen-ion addition. For example, it is preferable to add KI in an amount greater than a specific amount to silver halide tabular grains under formation. In another suitable way of adding iodine ion, an iodine-ion releasing agent is added to an emulsion comprising tabular grains to constitute the core, as described in JP-A-06-27564 and JP-A-05-341418.

In the other method (2), an epitaxial growth of iodide is created on the tabular core by adding an aqueous solution of silver salt and an aqueous solution containing iodine ion to an emulsion comprising tabular grains as the core. Therein, an adsorptive substance, e.g., a spectral sensitizing dye, can be used as a localization controlling agent for the epitaxial growth, if desired, as described in JP-A-59-133540, JP-A-58-108526 and JP-A-59-162540. Instead of adding the iodine ion solution, it is preferable to add fine grains (grain size: generally 0.1 μm or less, preferably 0.06 μm or less) of silver iodide or a silver halide having lower solubility than the silver halide forming the core to an emulsion comprising tabular grains as the core. Such the technique are described in JP-A-03-213845. As the method of supplying fine grains of silver iodide, it is preferable to adopt the preparation method disclosed in U.S. Pat. No. 4,879,208.

The pAg of an emulsion in which the epitaxial growth of an iodide-rich silver halide is being created ranges preferably from 6.4 to 10.5, and more preferably from 7.1 to 10.2. After the epitaxy formation of an iodide-rich silver halide on tabular grains as the core in the above-described manner, the resulting core is made to further grow, thereby forming a shell phase. In the tabular grains thus formed, it is desirable that the proportion of the core phase in the total silver halide grain be preferably from 5 to 80%, more preferably from 10 to 70%, on a silver content basis, the proportion of the internal iodide-rich phase in the total silver halide grain be preferably from 20 to 1%, more preferably from 10 to 1%, most preferably from 5 to 1%, on a silver content basis, and the proportion of the shell phase in the total silver halide grain be preferably from 19 to 94%, more preferably from 30 to 80%, on a silver content basis. Further, it is desirable that the iodide content in the core phase be preferably from 0 to 40 mole %, more preferably from 0 to 20 mole %, most preferably from 0 to 10 mole %, the iodide content in the internal iodide-rich phase be generally from 20 to 100 mole %, preferably from 30 to 100 mole %, more preferably from 50 to 100 mole %, most preferably 100 mole %, and the iodide content in the shell phase be lower than that in the internal iodide-rich phase, specifically in the range of preferably 0 to 12 mole %, more preferably 0 to 10 mole %, most preferably 0 to 5 mole %. Furthermore, it is desirable that the iodide content in the internal iodide-rich phase be higher than that in the shell phase by preferably at least 10 mole %, more preferably at least 20 mole %; while it is desirable that the iodide content in the core phase be lower than that in the internal iodide-rich phase by preferably at least 5 mole %, more preferably at least 10 mole %.

In forming the aforementioned shell phase for the tabular grains of the present invention, a crystal habit controlling agent represented by formula (I) or (II) is made to be present in a part or all of the shell formation process;

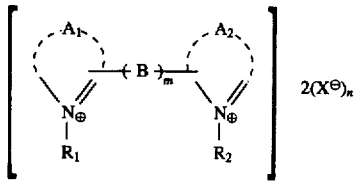

(I)

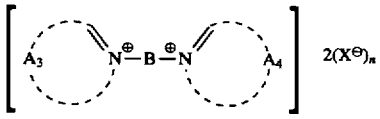

(II)

wherein $A_1$, $A_2$, $A_3$ and $A_4$ are the same or different, and each represents nonmetal atoms (necessary) for completing a nitrogen-containing heterocyclic ring; B represents a divalent linkage group; m is 0 or 1; $R_1$ and $R_2$ each represent an alkyl group; X represents an anion; and n is 0 or 1. When n is 0, the corresponding compounds are inner salts.

The foregoing formulae (I) and II) are illustrated below in detail.

Nonmetal atoms represented by $A_1$, $A_2$, $A_3$ or $A_4$ (necessary) for completing a nitrogen-containing heterocyclic ring may include an oxygen atom, a nitrogen atom or a sulfur atom, and the heterocyclic ring completed may be a benzene-condensed ring. The heterocyclic rings completed by $A_1$, $A_2$, $A_3$ and $A_4$ may have substituent groups, and they may be the same or different. Specific examples of substituent group(s) which those heterocyclic rings may have include an alkyl group, an aryl group, an aralkyl group, an alkenyl group, a halogen atom, an acyl group, an alkoxycarbonyl group, an aryloxycarbonyl group, a sulfo group, a carboxyl group, a hydroxy group, an alkoxy group, an aryloxy group, an amido group, a sulfamoyl group, a carbamoyl group, an ureido group, an amino group, a sulfonyl group, a cyano group, a nitro group, a mercapto group, an alkylthio group and an arylthio group. Preferred examples of heterocyclic rings completed by $A_1$, $A_2$, $A_3$ and $A_4$ include 5- and 6-membered rings, such as a pyridine ring, an imidazole ring, a thiazole ring, an oxazole ring, a pyrazine ring and a pyrimidine ring. Of these rings, a pyridine ring is particularly preferred.

B represent a divalent linkage group, with specific examples including an alkylene group, an arylene group, an alkenylene group, $—SO_2—$, —SO—, —O—, —S—, —CO—, $—N(R_3)—$ (wherein $R_3$ is an alkyl group, an aryl group or a hydrogen atom), and groups constituted of two or more of the above groups.

Examples of the divalent linkage group preferred for B include an alkylene group and an alkenylene group.

$R_1$ and $R_2$ may be the same or different, and each is an alkyl group having 1 to 20 carbon atoms.

Such the alkyl group may be substituted or not. Examples of the substituent group for the alkyl group include the above groups for the substituents of $A_1$, $A_2$, $A_3$ and $A_4$.

The alkyl groups preferred as $R_1$ and $R_2$ respectively are those having 4 to 10 carbon atoms. More preferably, $R_1$ and $R_2$ each are an unsubstituted or substituted aryl group-substituted alkyl group.

X is an anion, with examples including chloride ion, bromide ion, iodide ion, nitrate ion, sulfate ion, p-toluenesulfonate ion and oxalate ion.

n is 0 or 1. When the corresponding compound is an inner salt, n=0.

Specific examples of compounds represented by formulae (I) and (II) respectively are illustrated below. However, the present invention should not be construed as being limited to these compounds.

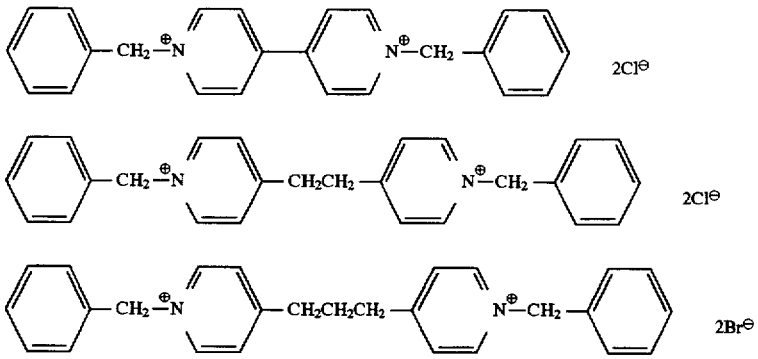

-continued

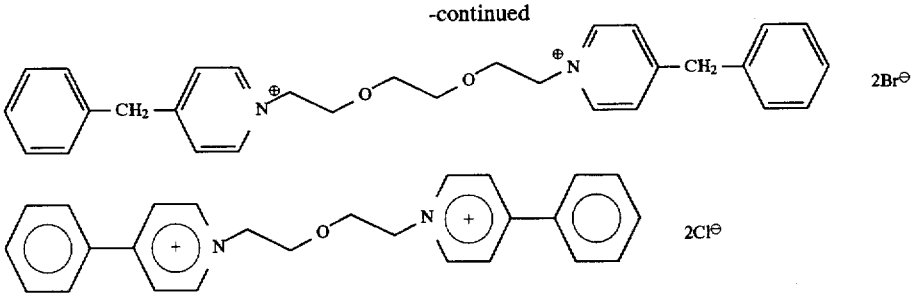

For examples of compounds represented by formulae (I) and (II) respectively, the description in JP-A-02-32 can be referred to.

The amount of the compound represented by formula (I) or (II) used in the present invention is from $1\times10^{-5}$ to $3\times10^{-1}$ mole per mole of silver halide, and particularly preferably from $2\times10^{-4}$ to $1\times10^{-1}$ mole per mole of silver halide.

Also, a crystal habit controlling agent represented by formula (III) can be used:

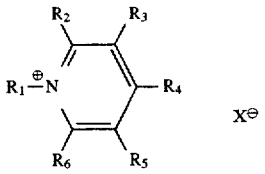

(III)

wherein $R_1$ represents an alkyl group, an alkenyl group or an aralkyl group; and $R_2$, $R_3$, $R_4$, $R_5$ and $R_6$ each represent a hydrogen atom or a group capable of replacing a hydrogen atom, or $R_2$ and $R_3$, $R_3$ and $R_4$, $R_4$ and $R_5$, or $R_5$ and $R_6$ are combined with each other to form a condensed ring.

$X^{31}$ represents a counter anion.

Further, the formula (III) is illustrated in detail below.

$R_1$ in formula (III) represents a straight-chain, branched or cyclic alkyl group having 1 to 20 carbon atoms (e.g., methyl, ethyl, isopropyl, t-butyl, n-octyl, n-decyl, n-hexadecyl, cyclopropyl, cyclopentyl, cyclohexyl), an alkenyl group having 2 to 20 carbon atoms (e.g., allyl, 2-butenyl, 3-pentenyl), or an aralkyl group having 7 to 20 carbon atoms (e.g., benzyl, phenetyl). Each of these groups may have a substituent group. Suitable examples of such the substituent group include the groups capable of substituting, which are described in the following definition of $R_2$ to $R_6$.

$R_2$, $R_3$, $R_4$, $R_5$ and $R_6$ may be the same or different, and each is a hydrogen atom or a group capable of substituting (i.e., replacing a hydrogen atom). Specific examples of such the group include halogen atoms (e.g., fluorine, chlorine, bromine), alkyl groups (e.g., methyl, ethyl, n-propyl, isopropyl, t-butyl, n-octyl, cyclopentyl, cyclohexyl), alkenyl groups (e.g., allyl, 2-butenyl, 3-pentenyl), alkinyl groups (e.g., propargyl, 3-pentinyl), aralkyl groups (e.g., benzyl, phenetyl), aryl groups (e.g., phenyl, naphthyl, 4-methylphenyl), heterocyclic groups (e.g., pyridyl, furyl, imidazolyl, piperidyl, morpholino), alkoxy groups (e.g., methoxy, ethoxy, butoxy), aryloxy groups (e.g., phenoxy, 2-naphthyloxy), amino groups (e.g., unsubstituted amino, dimethylamino, ethylamino, anilino), acylamino groups (e.g., acetylamino, benzoylamino), ureido groups (e.g., unsubstituted ureido, N-methylureido, N-phenylureido), urethane groups (e.g., methoxycarbonylamino, phenoxycarbonylamino), sulfonylamino groups (e.g., methylsulfonylamino, phenylsulfonylamino), sulfamoyl groups (e.g., unsubstituted sulfamoyl, N,N-dimethylsulfamoyl, N-phenylsulfamoyl), carbamoyl groups (e.g., unsubstituted carbamoyl, N,N-diethylcarbamoyl, N-phenylcarbamoyl), sulfonyl groups (e.g., mesyl, tosyl), sulfinyl groups (e.g., methylsulfinyl, phenylsulfinyl), alkyloxycarbonyl groups (e.g., methoxycarbonyl, ethoxycarbonyl), aryloxycarbonyl groups (e.g. phenoxycarbonyl), acyl groups (e.g., acetyl, benzoyl, formyl, pivaloyl), acyloxy groups (e.g., acetoxy, benzoyloxy), phosphoric acid amide groups (e.g., N,N-diethylphosphoric acid amide), alkylthio groups (e.g., methylthio, ethylthio), arylthio groups (e.g., phenylthio), a cyano group, a sulfo group, a carboxyl group, a hydroxy group, a phosphono group, a nitro group, a sulfino group, ammonio groups (e.g., trimethylammonio), a phosphonio group, a hydrazino group, and so on. These groups each may further be substituted. When they have two or more substituent groups, those substituent groups may be the same or different.

In formula (III), a quinoline ring, an isoquinoline ring or an acridine ring may be formed by combining $R_2$ and $R_3$, $R_3$ and $R_4$, $R_4$ and $R_5$, or $R_5$ and $R_6$.

$X^{31}$ represents a counter anion. Specific examples of such the counter anion include halide ions (e.g., chloride ion, bromide ion), nitrate ion, sulfate ion, p-toluenesulfonate ion, trifluoromethanesulfonate ion and so on.

In formula (III), it is desirable that $R_1$ be an aralkyl group and at least one of $R_2$, $R_3$, $R_4$, $R_5$ and $R_6$ be an aryl group.

Further, it is preferable that $R_1$ be an aralkyl group, $R_4$ be an aryl group and $X^{31}$ be a halide ion.

Specific examples of a compound of formula (III) relating to the present invention are illustrated below However, the present compounds should not be construed as being limited to these examples.

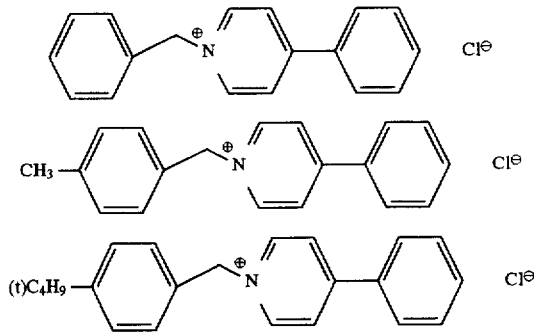

-continued

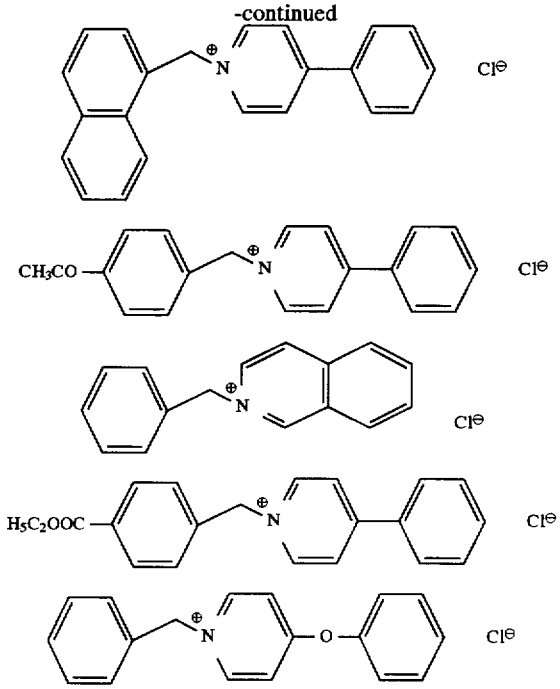

In the present invention, the compound represented by formula (III) can be used in an amount of $1\times10^{-5}$ to $1\times10^{-5}$ mole per mole of silver halide, and particularly preferably from $2\times10^{-4}$ to $1\times10^{-1}$ mole per mole of silver halide.

Further, a crystal habit controlling agent represented by formula (IV) can be preferably used:

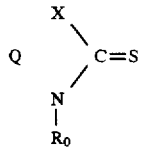

(IV)

wherein X represents a sulfur or oxygen atom, preferably a sulfur atom; Q represents atoms necessary for completing a 5- or 6-membered heterocyclic ring, such as a thiazolidine-2-thione ring, a 4-thiazoline-2-thione ring, 1,3,4-thiadiazoline-2-thione ring, a benzothiazoline-2-thione ring, a benzoxazoline-2-thione ring, etc.; and $R_0$ represents an alkyl group (e.g., methyl, ethyl, propyl, butyl, octyl), an alkenyl group (e.g., allyl), an aralkyl group (e.g., benzyl, phenetyl), an aryl group (e.g., phenyl), or a heterocyclic group (e.g., pyridyl).

Also, the heterocyclic ring completed by Q and the group represented by $R_0$ each may further be substituted, or not.

Examples of the substituent groups include halogen atoms, alkyl groups, aryl groups, alkoxy groups, aryloxy groups, sulfonyl groups, sulfonamido groups, amido groups, acyl groups, sulfamoyl groups, carbamoyl groups, ureido groups, alkoxycarbonylamino groups, aryloxycarbonylamino groups, alkoxycarbonyl groups, aryloxycarbonyl groups, aminocarbonylthio groups, alkylcarbonylthio groups, arylcarbonylthio groups, a cyano group, a hydroxy group, a mercapto group, a carboxyl group, a sulfo group, a nitro group, amino groups, alkylthio groups, arylthio groups, heterocyclic groups or so on.

Specific examples of a compound represented by formula (IV) which can be used in the present invention are illustrated below. However, the scope of the present invention should not be construed as being limited to these compounds.

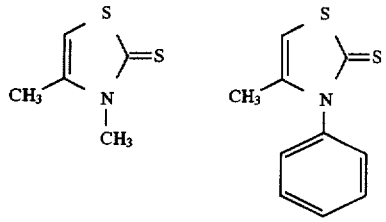

In addition to the above compounds, the compounds described in JP-A-01-155332 can be used as compounds of formula (IV).

In the present invention, the compound represented by formula (IV) can be used in an amount of $2\times10^{-5}$ to $3\times10^{-1}$ mole per mole of silver halide, and particularly preferably from $2\times10^{-4}$ to $3\times10^{-1}$ mole per mole of silver halide.

Furthermore, a crystal habit controlling agent represented by formula (v) can be preferably used:

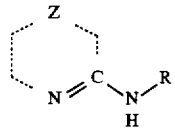

(V)

wherein Z represents atoms necessary for completing a 6-membered membered heterocyclic ring and, which comprises carbon and nitrogen atoms; and R represents a hydrogen atom, or a monovalent amino group-substituted group (e.g., a hydrocarbon group), or atoms necessary for completing a 5- or 6-membered heterocyclic ring by being fused together with the ring completed by Z.

Specific examples of a compound represented by formula (V) include the aminoazaindenes disclosed in U.S. Pat. No. 4,400,463, the 4-aminopyrazolo[3,4-d]pyrimidines disclosed in U.S. Pat. Nos. 4,713,323 and 4,804,621, the xanthines disclosed in U.S. Pat. No. 5,178,998, and the triaminopyrimidines disclosed in U.S. Pat. No. 5,185,239. In the present invention, the compound represented by formula (V) can be used in an amount of $1\times10^{-5}$ to $3\times10^{-1}$ mole per mole of silver halide, and particularly preferably from $2\times10^{-4}$ to $1\times10^{-1}$ mole per mole of silver halide.

The compounds represented by formulae (I) to (V) are selectively adsorbed to (111) faces as compared with (100) faces, and so they have a function of stabilizing the (111) faces. The tabular grains according to the present invention can be obtained by the presence of those crystal habit controlling agents (having a (111) face-selectivity) during the shell formation. Any compounds can be used as the controlling agent relating to the present invention as far as they have selective adsorptivity to (111) face, even if they are not included in the compounds of the foregoing formulae (I) to (v).

Whether or not some compound produces a crystal habit controlling effect in the form of (111) face selection useful for the present invention can be easily found out by a testing method as described below. Specifically, the testing method consists of the following steps: Cubic silver bromide grains having (100) face are formed from silver nitrate and potassium bromide at 75° C. in accordance with a controlled double jet method wherein alkali-processed bone gelatin is used as a dispersing medium and the silver potential is adjusted to +90 mV with reference to a saturated calomel electrode, and on the way to the grain formation under the aforementioned condition, a compound to be examined is added. If the compound added has (111) face-selectivity to function as a crystal habit controlling agent, (111) faces begin to appear on the individual cubic grains to convert their cubic form in to a detradecahedral form (having round corners at times) and further into an octahedral form whose faces all are (111) faces. Accordingly, whether or not the compound examined has a crystal habit controlling effect becomes clear by observing crystal shapes of the grains obtained.

If the aforementioned crystal habit controlling agent, which has the (111) face-selectivity, is absent, dislocation lines generated at the core-shell interface inhibit the tabular grains from growing in the transverse direction; as a result, the tabular grains come to grow in the thickness direction alone. Although the reason why such the dislocations can inhibit the crystal growth in the transverse direction are not clear, this action of the dislocations on the crystal growth causes by all means a reduction in the projected area of the shell part containing dislocation lines. Even if dislocations are created before the core becomes large with the intention of raising a proportion of the shell part, tabular grains uselessly grow in the thickness direction alone because the growth in the transverse direction can no longer be made from the dislocation-generating points; as a result, the aspect ratio of the tabular grains is merely lowered. Thus, it becomes impossible to take advantage of the characteristics of tabular grains. However, this problem can be solved by the technique disclosed in the present invention. More specifically, even if dislocations are present, the growth of tabular grains in the transverse direction becomes possible so far as a crystal habit controlling agent having the selectivity for adsorption to (111) faces is present in the shell formation after the generation of dislocations on the core. It is thought that the crystal habit controlling agent is selectively adsorbed to the main plane of tabular grains which are (111) faces, and thereby the growth in the thickness direction is considerably inhibited; as a result, the speed of the growth in the transverse direction becomes higher as compared with that in the thickness direction. in accordance with the technique disclosed in the present invention, it is therefore possible to prepare the tabular grains containing dislocations whose aspect ratio is high and wherein the shell part containing dislocations is present in a high proportion on a projected area basis.

Silver halide grains are prepared using gelatin as a protective colloid. As the gelatin, alkali-processed gelatin is usually employed. In particular, it is preferred to use the alkali-processed gelatin which has undergone a deionization or/and ultrafiltration treatment in order to remove therefrom foreign ions and impurities. In addition to alkali-processed gelatin, which are also usable in the present invention, acid-processed gelatin, gelatin derivatives such as phthaloylated gelatin, esterified gelatin and the like, low molecular weight gelatin (having a molecular weight of from 1,000 to 80,000, including enzyme-decomposed gelatin, acid and/or alkali hydrolyzed gelatin and pyrolyzed gelatin), high molecular weight gelatin (molecular weight: $1.1\times10^5$ to $3.0\times10^5$), gelatin having a methionine content of 50 micromole/g or less, gelatin having a tyrosine content of 20 micromole/g or less, oxidation-processed gelatin, or gelatin whose methionine moieties are inactivated by alkylation can be used. Two or more of those gelatins may be used as a mixture. The amount of gelatin used in the step of grain formation is generally from 1 to 60 g per mole of silver, and preferably from 3 to 40 g per mole of silver. The gelatin concentration in a step after the grain formation, e.g., in the chemical sensitization step, is preferably from 1 to 100 g per mole of silver, and more preferably from 1 to 70 g per mole of silver. Additionally, the present invention can fully achieve its effects when gelatin is used in a relatively large amount (or at least 10 g per mole of silver).

In the preparation of the silver halide emulsion of the present invention, there is no particular restrictions as to additives which can be added during the period from the grain formation to the emulsion-coating.

For the purposes of accelerating the growth of crystal in the crystal formation step and effectively performing the chemical sensitization in the grain formation and/or chemical sensitization step, a silver halide solvent can be employed. Compounds which can be used as the silver halide solvent are water-soluble thiocyanates, ammonia, thioethers and thioureas. Specific examples of such the silver halide solvent include the thiocyanates described in U.S. Pat. Nos. 2,222,264, 2,448,534 and 3,320,069, ammonia, the thioether compounds described in U.S. Pat. Nos. 3,271,157, 3,574,628, 3,704,130, 4,297,439 and 4,276,347, the thione compounds described in JP-A-53-144319, JP-A-53-82408 and JP-A-55-77737, the amine compounds described in JP-A-54-100717, the thiourea derivatives described in JP-A-55-2982, the imidazoles described in JP-A-54-100717, and the substituted mercaptotetrazoles described in JP-A-57-202531.

The present invention has no particular restrictions as to the method for making a silver halide emulsion. In general, aqueous solutions of a silver salt and halide(s) are added under efficient agitation to a reaction vessel in which a aqueous gelatin solution is placed. Specifically, a silver halide emulsions can be prepared using the methods described e.g., in P. Glafkides, *Chimie et Physique Photographique* (published by Paul Montel in 1967); G. F. Duffin, *Photographic Emulsion Chemistry* (published by The Focal Press in 1966); V. L. Zelikman et al., *Making and Coating Photographic Emulsion* (published by The Focal Press in 1964); and so on. More specifically, an acid process, a neutral process, an ammonia process and other conventional processes may be employed, and suitable methods for reacting a soluble silver salt with a soluble halide include, e.g., a single jet method, a double jet method, or a combination thereof.

Also, the so-called controlled double jet method, in which the pAg of the liquid phase in which silver halide grains are formed is maintained constant, may also be employed. In addition, it is desirable that the grain growth be speeded up within the critical saturation limit using the method of changing the addition speeds of silver nitrate and an alkali halide depending on the grain growth speed (as described in British Patent 1,535,016, JP-B-48-36890 and JP-B-52-16364) or the method of changing the concentrations of aqueous solutions (as described in British Patent 4,242,445 and JP-A-55-158124). Those methods are used to advantage in securing the prevention of re-nucleation and the uniform growth of silver halide grains.

In general, a silver halide emulsion is subjected to spectral sensitization. As dyes suitable for spectral sensitization, methine dyes are usually used. Examples of such methine dyes include cyanine dyes, merocyanine dyes, complex cyanine dyes, complex merocyanine dyes, holopolar cyanine dyes, hemicyanine dyes, styryl dyes and hemioxonol dyes. Any ring (i.e., nuclei) which is ordinarily used for cyanine dyes can be the basic heterocyclic ring of those dyes. Specific examples of basic heterocyclic rings include pyrroline, oxazoline, thiazoline, pyrrole, oxazole, thiazole, selenazole, imidazole, tetrazole and pyridine rings. In addition, rings formed by fusing together one of the above-described rings and an alicyclic or aromatic hydrocarbon ring can be utilized as basic heterocyclic rings. Specific examples of those fused rings include indolenine, benzindolenine, indole, benzoxazole, naphthoxazole, benzimidazole, benzothiazole, naphthothiazole, benzoselenazole and quinoline nuclei. These rings each may have substituent(s) attached to carbon atom(s) thereof.

The merocyanine and complex merocyanine dyes can contain 5- or 6-membered heterocyclic rings, e.g., pyrazoline-5-one, thiohydantoin, 2-thioxazolidine-2,4-dione, thiazolidine-2,4-dione, rhodanine and thiobarbituric acid rings, as ketomethylene structure-containing rings.

The amount of sensitizing dyes added is preferably from 0.001 to 100 millimole, more preferably from 0.01 to 10 millimole, per mole of silver halide.

As the addition time of sensitizing dyes, the dyes are preferably added during or before the chemical sensitization (e.g., at the grain formation or physical ripening step).

Substances which can exhibit a supersensitizing effect in a combination with a certain sensitizing dye although they themselves do not spectrally sensitize silver halide emulsions or do not absorb light in the visible region may be added to the silver halide emulsions. For instance, aminostilbene compounds substituted with nitrogen-containing heterocyclic groups (as described in U.S. Pat. Nos. 2,933,390 and 3,635,721), aromatic organic acid-formaldehyde condensates (as described in U.S. Pat. No. 3,743,510), cadmium salts and azaindene compounds can be used. Specific combinations of sensitizing dyes and the above-described dyes or materials are described in U.S. Pat. Nos. 3,615,613, 3,615,641, 3,617,295 and 3,635,721.

In general, silver halide emulsions are used after chemical sensitization is carried out. The chemical sensitization can be effected using chalcogen sensitization (including sulfur sensitization, selenium sensitization and tellurium sensitization), noble metal sensitization (e.g., gold metal sensitization) and reduction sensitization, individually or in combination of two or more thereof.

In the sulfur sensitization, labile sulfur compounds are used as sensitizer. With respect to the labile sulfur compounds, there are the description thereof in P. Glafkides, *Chimie et Physique Photographique* (published as the 5th edition by Paul Montel in 1987) and *Research Disclosure*, Vol. 307, No. 307105. Suitable examples of a sulfur sensitizer include thiosulfates (e.g., hypo), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethylrhodanine, 5-benzylidene-N-ethyl-rhodanine), phosphine sulfides (e.g., trimethylphosphine sulfide), thiohydantoines, 4-oxo-oxazolidine-2-thiones, dipolysulfides (e.g., dimorpholine disulfide, cystine, hexathiocanethion), mercapto compounds (e.g., cystine), polythionates and elemental sulfur. Also, active gelatin can be used as a sulfur sensitizer.

In the selenium sensitization, labile selenium compounds are used as sensitizer. Such the labile selenium compounds are described in JP-B-43-13489, JP-B-44-15748, JP-A-04-25832, JP-A-04-109240, JP-A-04-271341 and JP-A-05-40324. Specific examples of a selenium sensitizer which can be used include colloidal metallic selenium, selenoureas (e.g., N,N-dimethylselenourea, trifluoromethylcarbonyltrimethylselenourea, acetyl-trimethylselenourea), selenoamides (e.g., selenoacetamide, N,N-diethylphenylselenoamide), phosphine selenides (e.g., triphenylphosphine selenide, pentafluorophenyltriphenylphosphine selenide), selenophosphates (e.g., tri-p-tolylselenophosphate, tri-n-butylselenophosphate), selenoketones (e.g., selenobenzophenone), isoselenocyanates, selenocarboxylic acids, selenoesters and diacylselenides. In addition, comparatively stable selenium compounds such as selenous acid, potassium selenocyanide, selenazoles and selenides (e.g., the compounds described in JP-B-46-4553 and JP-B-52-34492) can also be used as selenium sensitizer.

In the tellurium sensitization, labile tellurium compounds can be used as sensitizer. Such the labile tellurium compounds are described in Canadian Patent 800,958, British Patents 1,295,462 and 1,396,696, JP-A-04-204640, JP-A-04-271341, JP-A-04-333043 and JP-A-05-303157. Specific examples of the tellurium sensitizer include telluroureas (e.g., tetramethyltellurourea, N,N-dimethylethylenetellurourea, N,N'-diphenylethylenetellurourea), phosphine tellurides (e.g., butyl-diisopropylphosphine telluride, tributylphosphine telluride, tributoxyphosphine telluride, ethoxydiphenylphosphine telluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluide, bis(ethoxycarbonyl)telluride), isotellurocyanates, telluroamides, tellurohydrazides, telluroesters (e.g., butyl hexyl telluroester), telluroketones (e.g., telluroacetophenone), colloidal tellurium, (di) tellurides and other tellurium compounds e.g., potassium telluride, sodium telluropentathionate).

In the noble metal sensitization, the salts of noble metals, such as gold, platinum, palladium, iridium and the like, are used as sensitizer. Such noble metal salts are described in P. Glafkides, *Chimie et Physique Photographique* (published as the 5th edition by Paul Montel in 1967) and *Research Disclosure*, Vol. 307, No. 307105. In particular, gold sensitization is preferred. The present invention can achieve a particularly excellent effect when gold sensitization is carried out.

The fact that removal of gold from the sensitized nuclei on emulsion grains can be attained with a solution containing potassium cyanide (KCN) is described in *Photographic Science and Engineering*, Vol. 19322 (1975 and *Journal of Imaging Science*, Vol. 3228 (1988). According to the descriptions therein, cyanide ions make it possible to liberate the gold atoms or gold ions adsorbed to silver halide grains in the form of cyan complex; as a result, they hinder gold sensitization. Therefore, effects of gold sensitization can fully be achieved if generation of cyan is prevented.

Specific examples of a gold sensitizer which can be used in the present invention include chloroauric acid, potassium chloroaurate, potassium aurithiocyanate, gold sulfide and gold selenide. In addition, the gold compounds described in U.S. Pat. Nos. 2,642,361, 5,049,484 and 5,049,485 can also be used.

In the reduction sensitization, reducing compounds are used as sensitizer. Such the reducing compounds are described in P. Glafkides, *Chimie et Physique Photographique* (published as the 5th edition by Paul Montel in 1987) and *Research Disclosure*, Vol. 307, No. 307105. Specific examples of a reduction sensitizer include aminoiminomethanesulfinic acids (thiourea dioxide), borane compounds (e.g., dimethylamineborane), hydrazine compounds (e.g., hydrazine, p-tolylhydrazine), polyamine compounds (e.g., diethylenetriamine, triethylenetetramine), stannous salts, silane compounds, reductones (e.g., ascorbic acid), sulfites, aldehyde compounds and hydrogen gas. In addition, reduction sensitization can also be effected under high pH and an atmosphere of excess silver ion (the so-called silver ripening).

In the chemical sensitization, two or more of the aforementioned sensitization processes may be combined. In particular, the combination of a chalcogen sensitization with a gold sensitization is preferred. In addition, it is preferable for the reduction sensitization to be performed during the formation of silver halide grains. The amount of sensitizers to be used depends on the kinds of silver halide used and the conditions of chemical sensitization.

The amount of a chalcogen sensitizer used is generally from $1\times10^{-8}$ to $1\times10^{-2}$ mole, preferably from $1\times10^{-7}$ to $5\times10^{-3}$ mole, per mole of silver halide.

The amount of a noble metal sensitizer used is preferably from $1\times10^{-7}$ to $1\times10^{-2}$ mole per mole of silver halide.

The present invention has no particular restrictions as to conditions of chemical sensitization. As a general guide to the conditions, the pAg is generally from 6 to 11, and preferably from 7 to 10; the pH is preferably 4 to 10; and the temperature is preferably from 40 to 95° C., and more preferably from 45 to 85° C.

The silver halide emulsion of the present invention can contain a wide variety of compounds for the purpose of prevention of fogging and stabilization of photographic properties during the production, storage or photographic processing of the resulting photosensitive material. Specific examples of such the compounds include azoles (e.g., benzothiazolium salts, nitroindazoles, triazoles, benzotriazoles, benzimidazoles (especially nitro- or halogen-substituted compounds)); heterocyclic mercapto compounds (e.g., mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines); the above-described heterocyclic mercapto compounds substituted with water-soluble groups such as a carboxyl group, a sulfo group, etc.; thioketo compounds (e.g., oxazolinethione); azaindenes (e.g., tetrazaindenes (particularly 4-hydroxy-substituted (t,3,3a,7) tetrazaindenes); benzenethiosulfonic acids; and benzenesulfinic acids. These compounds are generally known as an antifoggant or a stabilizer.

Those antifoggants and stabilizers are generally added after chemical sensitization. However, they may also be added at an appropriate time on the way to or before the chemical sensitization. More specifically, the addition time thereof may be during adding a silver salt solution in course of the formation of silver halide emulsion grains, within the period from the end of the addition of a silver salt solution to the start of chemical sensitization, or in course of chemical sensitization (e.g., within the term from the start preferably to the halfway point, more preferably to 20% point, of the chemical sensitization period).

Silver halide photographic materials according to the present invention have no particular restrictions as to layer structure. In the case of the color photographic materials, they have a multilayer structure in order to record blue light, green light and red light separately. Further, each silver halide emulsion layer may have two constituent layers, namely a high-speed emulsion layer and a low-speed emulsion layer.

Practical examples of a layer structure are illustrated below:

(1) BH/BL/GH/GL/RH/RL/S
(2) BH/BM/BL/GH/GM/GL/RH/RM/RL/S
(3) BH/BL/GH/RH/GL/RL/S
(4) BH/GH/RH/BL/GL/RL/S
(5) BH/BL/CL/GH/GL/RH/RL/S
(6) BH/BL/GH/GL/CL/RH/RL/S

Therein, B means a blue-sensitive layer, G means a green-sensitive layer, R means a red-sensitive layer, H means a high-speed layer, M means a medium-speed layer, L means a low-speed layer, S means a support, and CL an interlayer effect-providing layer. In the above-described layer structures, light-insensitive layers such as a protective layer, a filter layer, an interlayer, an anti-halation layer and a subbing layer are omitted from their constituent layers. As the high- and low-speed layers having the same color sensitivity, the reverse of the arranging order as described above may be adopted.

Additionally, the above layer structure (3) is described in U.S. Pat. No. 4,184,876. The above layer structure (4) is described in RD-22534, JP-A-59-177551 and JP-A-59-177552. The above layer structures (5) and (6) are described in JP-A-61-34541.

Preferred layer structures are (1), (2) and (4).

The silver halide photographic materials according to the present invention can be applied to not only a color photographic material but also an X-ray photographic material, a black-and-white photosensitive material for photography, a photosensitive material for plate-making use and a photographic printing paper.

For details of various additives usable for the silver halide emulsions (e.g., binders, chemical sensitizers, spectral sensitizers, stabilizers, gelatin hardeners, surfactants, antistatic agents, polymer latexes, matting agents, color couplers, ultraviolet absorbents, discoloration inhibitors, dyes), supports of the photographic materials and processing methods for the photographic materials (e.g. coating method, exposing method, developing method) the descriptions in *Research Disclosure*, Vol. 176, item 17643 (RD-17643), ibid., Vol. 187, item 18716 (RD-18615) and ibid., Vol. 225, Item 22534 (RD-22534) can be referred to.

The pages on which such the additives are described in the above-described Research Disclosure are summarized in the following table.

| Additives | RD 17643 | RD 18716 | RD 22534 |
|---|---|---|---|
| 1. Chemical Sensitizers | p. 23 | p. 648, right column | p. 24 |
| 2. Sensitivity Increasing Agents | | p. 648, right column | |
| 3. Spectral Sensitizers and Supersensitizers | pp. 23–24 | p. 648, right column, to p. 649, right column | pp. 24–28 |
| 4. Brightening Agents | p. 24 | | |
| 5. Antifoggants and Stabilizers | pp. 24–25 | p. 649, right column | p. 24 and p. 31 |
| 6. Light Absorbents, Filter dyes and UV Absorbents | pp. 25–26 | p. 649, right column, to p. 650, left column | |
| 7. Stain Inhibitors | p. 25, right column | p. 650, left to right column | |
| 8. Dye Image Stabilizers | p. 25 | | p. 32 |
| 9. Hardeners | p. 26 | p. 651, left column | p. 28 |
| 10. Binders | p. 26 | p. 651, left column | |
| 11. Plasticizers and Lubricants | p. 27 | p. 650, right column | |
| 12. Coating Aids and Surfactants | pp. 26–27 | p. 650, right column | |
| 13. Antistatic Agents | p. 27 | p. 650, right column | |
| 14. Color Couplers | p. 25 | p. 649 | p. 31 |

As the gelatin hardeners, active halogen compounds (e.g., 2,4-dichloro-6-hydroxy- 1,3,5-triazine and sodium salt thereof) and active vinyl compounds (e.g., 1,3-bisvinylsulfonyl-2-propanol, 1,2-bis(vinylsufonylacetamido)ethane, vinyl polymers having vinylsulfonyl groups in their side chains) are preferred because they can rapidly harden hydrophilic colloids, including gelatin, to ensure stable photographic characteristics. Also, N-carbamoylpyridinium salts (e.g., 1-morpholinocarbonyl-3-pyridinio)methanesulfonate) and haloamidinium salts (e.g., 1-(1-chloro-1-pyridinomethylene)pyrrolidinium 2-naphthalenesulfonate) are excellent in hardening speed.

The color photographic materials according to the present invention can be development-processed using conventional methods described in the foregoing RD-17643 (pages 28–29) and RD-18716 (from left to right column on page 651).

After the development processing and the subsequent bleach-fixing or fixing processing, the color photographic materials are, in general, subjected to washing or stabilization processing.

In the washing step, water is generally saved by using at least two washing tanks in accordance with a counter-current replenishing method. As the stabilization processing as a substitute for wash processing, the multistage counter-current stabilization processing described in JP-A-57-8543 is exemplified as a representative example thereof.

EXAMPLE 1

(Preparation of Emulsions)

Emulsion 1

Silver iodobromide tabular-grain emulsion (Comparative Emulsion)

To 1.5 liter of a 0.8% solution of low molecular weight gelatin (average molecular weight: $1.0\times10^4$) in which 0.05 mole of potassium bromide was contained, 15 ml of a 0.5M silver nitrate solution and 15 ml of a 0.5M potassium bromide solution were added over a 15-second period with stirring in accordance with a double jet method. During the addition, the gelatin solution was kept at 40° C. (Thus, the nucleation was achieved.) Therein, the pH of the gelatin solution was 5.0. After the addition, the resulting solution was heated up to 75° C., and thereto was added 220 ml of a 10% solution of deionized alkali-processed gelatin. The thus obtained emulsion was ripened for 20 minutes, and then admixed with 80 ml of a 0.47M silver nitrate solution. Further, the emulsion was ripened for 10 minutes. (Thus, the intended ripening was completed.)

Thereafter, 150 g of silver nitrate and a potassium bromide solution were added over a 60-minute period at an accelerated flow rate (such that the final flow rate might be 19 times the initial flow rate) in accordance with a double jet method, wherein the silver potential was maintained at 0 mV. (Thus, the growth was achieved.) After completion of the addition, the resulting emulsion was admixed with 45 ml of a 10% KI solution (thereby effecting the conversion).

After a 5-minute lapse, 28 g of silver nitrate and potassium bromide were further added to the emulsion in accordance with a double jet method under a condition that the silver potential might be kept at −20 mV. (Thus, the shell was formed.) Thereafter, the emulsion was cooled to 35° C., and washed by an ordinary flocculation method. Further, 80 g of deionized alkali-processed bone gelatin was added thereto at 40° C., and dissolved therein. Furthermore, the pH and the pAg of the resulting emulsion were adjusted to 6.5 and 8.6, respectively, and the emulsion obtained was preserved in a cool and dark room. The thus formed tabular grains are silver iodobromide grains having an average diameter of 1.2 μm (the term "diameter" as used herein refers to the diameter of the circle equivalent to the projected area of each tabular grain), an average thickness of 0.18 μm and an iodide content of 2.48 mole %.

Emulsion 2

Silver iodobromide tabular-grain emulsion (Comparative Emulsion)

Another comparative emulsion was prepared in the same manner as Emulsion 1, except that the amount of silver nitrate added in the growth step was changed to 63 g and the amount of silver nitrate added in the shell formation step was changed to 155 g. The thus formed tabular grains had an average diameter of 0.80 μm and an average thickness of 0.32 μm.

Emulsion 3

Silver iodobromide tabular-grain emulsion (Emulsion of the present invention: Present Emulsion)

An emulsion was prepared in the same manner as Emulsion 2, except that 30 ml of a 1/50M solution of the following compound as a controlling agent of formula (I) was added before 30 seconds from the beginning of shell formation:

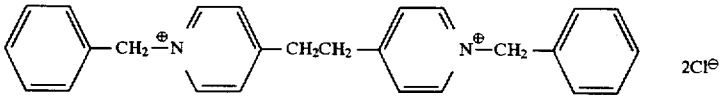

The thus formed tabular grains had an average diameter of 1.15 μm and an average thickness of 0.20 μm.

Emulsion 4

Silver iodobromide tabular-grain emulsion (Present Emulsion)

An emulsion was prepared in the same manner as Emulsion 2, except that 10 ml of a 1/50M solution of 4-aminopyrazolo [3,4-d]pyrimidine illustrated below as a controlling agent of 2-hydroaminoazine type (represented by formula (V)) was added at 1 minute after the beginning of shell formation:

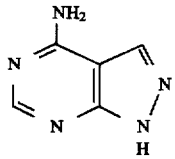

The thus formed tabular grains had an average diameter of 1.1 μm and an average thickness of 0.22 μm.

Emulsion 5

Silver iodobromide tabular-grain emulsion (Present Emulsion)

An emulsion was prepared in the same manner as Emulsion 2, except that 30 ml of a 1/50M solution of the following compound as a controlling agent represented by formula (III) was added before 30 seconds from the beginning of shell formation:

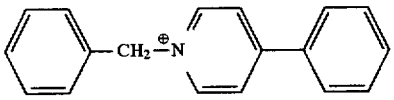

The thus formed tabular grains had an average diameter of 1.13 μm and an average thickness of 0.2 μm.

(Observation of Dislocations in Grains)

Emulsions 1, 2 and 5 were each examined for dislocations by direct observation with a transmission electron microscope, as described hereinbefore. Specifically, the observation was performed using an electron microscope ("Model JEM-2000FX", made by Japan Electron Optics Laboratory Co., Ltd.) at a voltage of 200 kV under the liquid nitrogen temperature.

The observation results are shown in FIG. 2. In Emulsion 1, dislocations of high density are localized at the edge part of a tabular grain, so that the portion of the shell part in which the dislocations are present is very small. in Emulsion 2 also, although the quantity of silver nitrate for the shell formation was increased, the proportion of the shell part containing dislocations is very small. This indicates that, since the shell growth was started after conversion, the tabular grains couldn't grow in the transverse direction any longer; as a result, the growth perpendicular to the main plane of each tabular grain took place with priority. Consequently, the length of dislocation lines is short, and the completed tabular grains are small in the diameter equivalent to circle and large in the thickness, that is, they have a low aspect ratio. This signifies that the completed grains lose the characteristics of tabular grains. In Emulsion 5, on the other hand, long dislocation lines of high density are observed in the shell part, and the proportion of the shell part containing dislocations to the core is remarkably high as compared with those in Emulsions 1 and 2, on a projected area basis. This demonstrates that, upon shell growth after conversion, the grains in the case of Emulsion 5 were able to grow in the transverse direction also, in contrast to the grains in the case of Emulsion 2. Therefore, each of the dislocation lines is long and the thickness of the completed tabular grains is small, that is to say, the aspect ratio is high. This observation result is attributable to the addition of the (111) crystal habit controlling agent of the present invention upon the shell formation.

The aforementioned results obtained with the transmission electron microscope and the aspect ratios of the emulsion grains prepared above are set forth in Table 1.

TABLE 1

| Emulsion | Shell/Core Ratio (silver basis) | Shell*/Core Ratio (projected area basis) | Average Aspect Ratio | Note |
|---|---|---|---|---|
| Emulsion 1 | 0.178 | 0.07 | 6.7 | Comparison |
| Emulsion 2 | 1.63 | 0.14 | 2.5 | Comparison |
| Emulsion 3 | " | 2.45 | 5.8 | Invention |
| Emulsion 4 | " | 2.21 | 5.0 | " |
| Emulsion 5 | " | 2.40 | 5.7 | " |

Shell*: The shell part containing dislocations.

The foregoing Emulsions 1 to 4 were each chemically sensitized at 58° C. Specifically, Sensitizing Dye (1) illustrated below was first added in an amount of $7\times10^{-4}$ mole/mole Ag at 40° C. and, after a 5-minute lapse from the addition, each emulsion was chemically sensitized with sodium thiosulfate, Selenium Compound (1) illustrated below chloroauric acid and potassium thiocyanate under the optimum condition.

Sensitizing Dye (1)

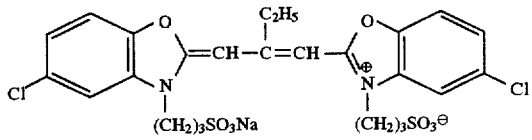

Selenium Compound (1)

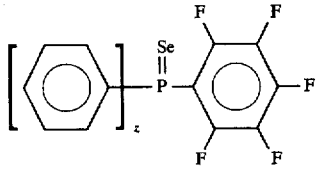

Each of the foregoing emulsions was coated on a transparent base at a coverage rate of 2 g/m$^2$. Each of the thus obtained samples was cut into two pieces, and the pieces were exposed for one second to blue light and yellow filter-transmitted light (that is to say yellow light), respectively, through a continuous wedge. Then, these exposed samples were developed with the following developer MAA-1 at 20° C. for 10 minutes.

Developer MAA-1

| | |
|---|---|
| Metol | 2.5 g |
| L-Ascorbic acid | 10.0 g |
| NABOX | 35.0 g |
| KBr | 1.0 g |
| $H_2O$ | 1.0 l |

The results obtained are shown in Table 2

TABLE 2

| Emulsion | Sensitivity to blue light | Sensitivity to yellow light | Note |
|---|---|---|---|
| Emulsion 1 | 100 | 100 | Comparison |
| Emulsion 2 | 120 | 120 | Comparison |
| Emulsion 3 | 115 | 140 | Invention |
| Emulsion 4 | 115 | 145 | Invention |
| Emulsion 5 | 115 | 140 | Invention |

Additionally, the sensitivities are expressed in terms of the reciprocal of the exposure amount providing the density of (fog+0.1), and the emulsions are evaluated by relative sensitivities, with the sensitivity of Emulsion 1 being taken as 100. A reason why Emulsion 1 had low sensitivities is that the silver iodide content at the grain surface was high because of its thin shell; as a result, the development was retarded. In Emulsion 2, the silver iodide content at the grain surface was reduced, so the corresponding increase in the sensitivity to blue light was brought about. Therein, however, the aspect ratio of each tabular grain was low and the surface area thereof was small, so the spectral sensitizing dye adsorbed thereto was small in number. Thus, the light absorption upon exposure to yellow light was reduced, and so the sensitivity to yellow light was not high. On the other hand, the present tabular grains had low silver iodide contents at their surfaces and high aspect ratios, so they enables the adsorption of many sensitizing dye molecules thereto. Thus, the tabular grains of the present invention came to have high sensitivities to yellow light.

EXAMPLE 2

On a cellulose triacetate support, Emulsions 1 to 5 prepared in Example 1 were each coated together with a protective layer under the following conditions, thereby preparing the emulsion-coated samples.

[Conditions of Emulsion-Coating]

(1) Constituents of Emulsion Layer

Each emulsion ($3.6\times10^{-2}$ mole/m$^2$, based on silver)

Coupler illustrated below ($1.5\times10^{-3}$ mole/m$^2$)

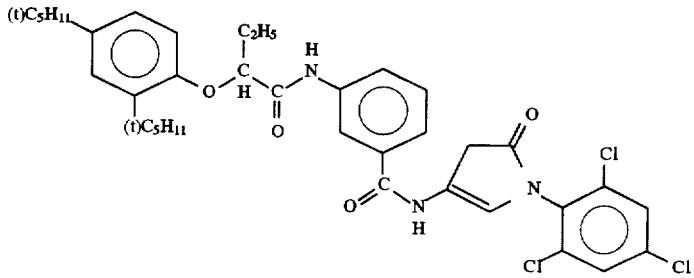

Tricresyl phosphate (1. 10 g/m$^2$)

Gelatin ( 2.30 g/m$^2$)

(2) Constituents of Protective Layer

Sodium salt of 2,4-dichloro-6-hydroxy-s-triazine (0.08 g/m$^2$)

Gelatin (1.80 g/m$^2$)

The thus prepared samples were allowed to stand for 14 hours under the condition of 40° C. and 70% RH, exposed to light for 1/100 second through a yellow filter and a continuous wedge, and subjected to the following color photographic processing.

Color Photographic Processing Conditions

| Processing Step | Processing Time | Processing Temperature |
|---|---|---|
| Color development | 2 min. 00 sec. | 40° C. |
| Bleach-Fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The composition of each processing bath used is described below.

Color Developing Solution

| | |
|---|---|
| Diethylenetriaminepentaacetic acid | 2.0 g |
| 1-Hydroxyethylidene-1,1-disulfone | |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-ethyl-N-β-hydroxyethylamino]-2-methyl-aniline sulfate | 4.5 g |
| Water to make | 1.0 l |
| pH adjusted to | 10.05 |

Bleach-Fixing Solution

| | |
|---|---|
| Ammonium ethylenediaminetetraacetate-ferrate(III) dihydrate | 90.0 g |
| Disodium ethylenediaminetetraacetate | 5.0 g |
| Sodium sulfite | 12.0 g |

-continued

| | |
|---|---|
| Aqueous solution of ammonium thiosulfate (70%) | 260.0 ml |
| Acetic acid (98%) | 5.0 ml |
| Bleach accelerator illustrated below | 0.01 mol |

-continued

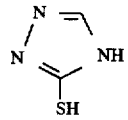

| | |
|---|---|
| Water to make | 1.0 l |
| pH adjusted to | 6.0 |

Washing Water:

City water passed through a mixed-bed column filled with an H-type cation exchange resin ("Amberlite IR-120B", manufactured by Rohm & Haas Co.) and an OH-type anion exchange resin ("Amberlite IR-400", manufactured by Rohm & Haas Co.), thereby reducing each of the calcium and magnesium ion concentrations to 3 mg/l or less, and then admixed with 20 mg/l of sodium dichloroisocyanurate and 1.5 g/l of sodium sulfate.

The pH of the resulting water is in the range of 6.5 to 7.5.

Stabilizing Solution:

| | |
|---|---|
| Formaldehyde (37%) | 2.0 ml |
| Polyoxyethylene-p-monononylphenylether (average polymerization degree: 10) | 0.3 mg |
| Disodium ethylenediaminetetraacetate | 0.05 mg |
| Water to make | 1.0 l |
| pH adjusted to | 5.0–8.0 |

The sensitivities are expressed in terms of the reciprocal of the exposure amount (lux·sec) providing the density of (fog+0.1), and the emulsions was evaluated by relative sensitivities, with Emulsion 1 being taken as 100. The exposure was carried out through a yellow filter and a continuous wedge.

TABLE 3

| Emulsion | Sensitivity | Note |
|---|---|---|
| Emulsion 1 | 100 | Comparison |
| Emulsion 2 | 120 | Comparison |
| Emulsion 3 | 145 | Invention |
| Emulsion 4 | 140 | Invention |
| Emulsion 5 | 145 | Invention |

EXAMPLE 3

The Emulsion 5 prepared in Example 1 was used in the fifth layer of the photosensitive material as Sample 6 (Sample No. 101) in Example 3 of JP-A-06-258788, and subjected to the same photographic processing as in that example. As a result, satisfactory properties were obtained.

EXAMPLE 4

The Emulsion 5 prepared in Example 1 was used as the emulsion for the Photosensitive Material X in Example 1 of JP-A-06-273860, combined with Screen B, and subjected to the same photographic processing as in that example. As a result, satisfactory properties were obtained.

While the invention has been described in detail and with reference to specific embodiments thereof it will be apparent to one skilled in the art that various changes and modifications can be made therein without departing from the spirit and scope thereof.

What is claimed is:

1. A method of preparing a silver halide photographic emulsion comprising tabular silver halide grains having a diameter/thickness ratio of at least 2 and (111) faces as parallel main planes, each of said grains being constituted of a core and a shell; wherein at least 30%, on a projected area basis, of the total silver halide grains are tabular grains which contain in their individual shells at least 15 dislocation lines reaching to the grain edges from the interface of the core and the shell and have the ratio of the shell part containing dislocation lines to the core, on a projected area basis, in the range shown as the shaded part in FIG. 1, and wherein the shell containing dislocations is grown in the presence of a crystal habit controlling agent.

2. The method as claimed in claim 1, wherein the tabular silver halide grain comprises silver iodobromide grain having an iodide content of 0.1 to 20 mole %.

* * * * *